US007494197B2

(12) United States Patent
Han et al.

(10) Patent No.: US 7,494,197 B2
(45) Date of Patent: Feb. 24, 2009

(54) CABINET FOR HOME APPLIANCE

(75) Inventors: In Hee Han, Changwon-si (KR); Seong Hai Jeong, Changwon-si (KR); Soon Jo Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 653 days.

(21) Appl. No.: 10/492,595

(22) PCT Filed: Jul. 31, 2003

(86) PCT No.: PCT/KR03/01547

§ 371 (c)(1),
(2), (4) Date: Apr. 15, 2004

(87) PCT Pub. No.: WO2004/011711

PCT Pub. Date: Feb. 5, 2004

(65) Prior Publication Data

US 2004/0244439 A1 Dec. 9, 2004

(30) Foreign Application Priority Data

Jul. 31, 2002 (KR) ..... 10-2002-0045344
Aug. 22, 2002 (KR) ..... 10-2002-0049775

(51) Int. Cl.
*A47B 47/00* (2006.01)

(52) U.S. Cl. ..... 312/265.6; 312/228; 312/263

(58) Field of Classification Search ..... 312/228, 312/228.1, 257.1, 263, 265.5, 265.6; 24/293, 24/295; 34/595, 603; 134/58 D; 403/353; 68/3 R See application file for complete search history.

(56) References Cited

U.S. PATENT DOCUMENTS

| | | | | | |
|---|---|---|---|---|---|
| 1,030,527 | A | * | 6/1912 | Nelson | 278/96 |
| 3,153,975 | A | * | 10/1964 | Rapata | 24/295 |
| 4,173,379 | A | * | 11/1979 | van der Heiden et al. | 312/348.1 |
| 4,295,693 | A | * | 10/1981 | Viklund | 312/265.5 |
| 4,307,588 | A | * | 12/1981 | Smith et al. | 68/23.7 |
| 4,462,647 | A | * | 7/1984 | Key | 312/265.5 |
| 4,618,193 | A | | 10/1986 | Cuthbert et al. | |
| 5,051,021 | A | * | 9/1991 | Pelz | 403/316 |
| 5,584,549 | A | * | 12/1996 | Lybarger et al. | 312/265 |
| 6,554,527 | B1 | * | 4/2003 | O'Donnell et al. | 403/353 |

FOREIGN PATENT DOCUMENTS

| | | |
|---|---|---|
| JP | 4144595 A | 5/1992 |
| JP | 8-299684 | 11/1996 |
| WO | WO-99/45188 A1 | 9/1999 |

* cited by examiner

*Primary Examiner*—James O Hansen
(74) *Attorney, Agent, or Firm*—McKenna Long & Aldridge LLP

(57) ABSTRACT

Cabinet for a home appliance including a base panel 10, one pair of side panels 20 respectively provided to side ends of the base panel 10, each having a size of holes 21 in a front end, a front panel 30 provided to front ends of the base panel and the side panels 10 and 20, the front panel 30 having projections 31 mounted on a rear surface thereof for being inserted in the holes 21 and engaged with circumferential portions 21*a* of the holes 21, respectively, and a rear panel 40 provided to rear ends of the base panel and the side panels 10 and 20.

33 Claims, 9 Drawing Sheets

CABINET FOR HOME APPLIANCE

This application claims priority from Korean Patent Application No. 2002-45344, filed Jul. 31, 2002 and Korean patent Application No. 2002-49775, filed Aug. 22, 2002, both of which are incorporated herein by reference in their entirety.

TECHNICAL FIELD

The present invention relates home appliances, and more particularly, to a cabinet for a home appliance.

BACKGROUND ART

As well known, the home appliance is provided with a cabinet and various components held in the cabinet. The components include sensitive electronic parts and mechanical parts that make various motions. For an example, a washing machine is provided with a tub rotating at a high speed and an electronic controller for controlling rotation of the tub. The cabinet protects the electronic parts against physical impacts and protects a user from the moving mechanical parts.

In general, the cabinet has a plurality of panels each with a certain strength to be assembled together. For assembly of the panels, the panels have flanges at ends for fastening with fastening members, such as screws.

However, a long time of work and many processes are actually required for formation of the flanges and mechanical joining of the flanges with the fastening members, resulting to reduce productivity of the home appliances. Under the same reason, the cabinet requires much time for disassembly, which is inconvenient for maintenance of the home appliance.

Moreover, the fastening members (i.e., screws) are fastened to some selected points of the flanges. Therefore, fastening force between the panels is weak relatively, for form gaps between the panels after the assembly, to permit leakage of operation noise there through.

DISCLOSURE OF INVENTION

An object of the present invention is to provide a cabinet of a home appliance, which permits an easy assembly of the cabinet.

In one aspect of the present invention for achieving the object of the present invention, there is provided a cabinet for a home appliance including a base panel, one pair of side panels respectively provided to side ends of the base panel, each having a size of holes in a front end, a front panel provided to front ends of the base panel and the side panels, the front panel having projections mounted on a rear surface thereof for being inserted in the holes and engaged with circumferential portions of the holes respectively, and a rear panel provided to rear ends of the base panel and the side panels.

The projection has a groove for receiving the circumferential portion of the hole for engagement with the circumferential portion. Preferably, the groove is in a lower surface of the projection, spaced a distance away from the rear surface of the front panel.

Preferably, the circumferential portion engaged with the projection includes a step part positioned in a lower part of the hole indent from the front panel.

More preferably, the projection is pulled toward the side panels by the circumferential portion, and actually engages with the circumferential portion while the projection deforms the circumferential portion, partially. To do this, the groove in the projection and the circumferential portion are not come into alignment when the side panel and the front panel are joined, and preferably the groove is in front of the circumferential portion. The groove has an enlarged entrance for helping insertion of the circumferential portion of the hole therein.

The projection may have a partially reduced section for easy insertion into the hole. The projection is separated from the hole by moving the projection upward.

Preferably, the front panel further includes a supplementary hole in a lower end thereof, and the base panel further includes a supplementary projection on a front end thereof inserted in the supplementary hole. The supplementary projection is separated from the hole by moving the hole upward.

The base panel is joined with the side panel and the rear panel without fastening members, directly. The base panel further includes first curled parts at side edges and rear edge thereof, and the side panels and the rear panel further include second curled parts at lower edges thereof respectively for engagement and joining with the first curled parts respectively.

The side panels and the rear panel are joined to each other directly, without fastening members. The side panels include third curled parts formed at rear ends respectively, and the rear panel includes fourth curled parts at side ends respectively for engagement, and joining with the third curled parts respectively.

In another aspect of the present invention, there is provided a washing machine including a washing tub rotatably mounted for washing laundry, a driving device for rotating the washing tub, and a cabinet for holding the washing tub and the driving device, including a base panel, one pair of side panels respectively provided to side ends of the base panel, each having a size of holes in a front end, a front panel provided to front ends of the base panel and the side panels, the front panel having projections mounted on a rear surface thereof for being inserted in the holes and engaged with circumferential portions of the holes, respectively, and a rear panel provided to rear ends of the base panel and the side panels.

In further aspect of the present invention, there is provided a dryer including a drum rotatably mounted for drying laundry, a driving device for rotating the drum, and a cabinet for holding the drum and the driving device, including a base panel, one pair of side panels respectively provided to side ends of the base panel, each having a size of holes in a front end, a front panel provided to front ends of the base panel and the side panels, the front panel having projections mounted on a rear surface thereof for being inserted in the holes and engaged with circumferential portions of the holes, respectively, and a rear panel provided to rear ends of the base panel and the side panels.

Thus, according to the present invention, the cabinet can be assembled without fastening members, which improves productivity and production cost.

BRIEF DESCRIPTION OF DRAWINGS

The accompanying drawings, which are included to provide a further understanding of the invention, illustrate embodiment(s) of the invention and together with the description serve to explain the principle of the invention. In the drawings.

BEST MODE FOR CARRYING OUT THE INVENTION

Reference will now be made in detail to the preferred embodiments of the present invention, examples of which are illustrated in the accompanying drawings. In describing the embodiments of the present invention, same parts with be given the same names and reference symbols, and repetitive description of which will be omitted.

Figure 1:
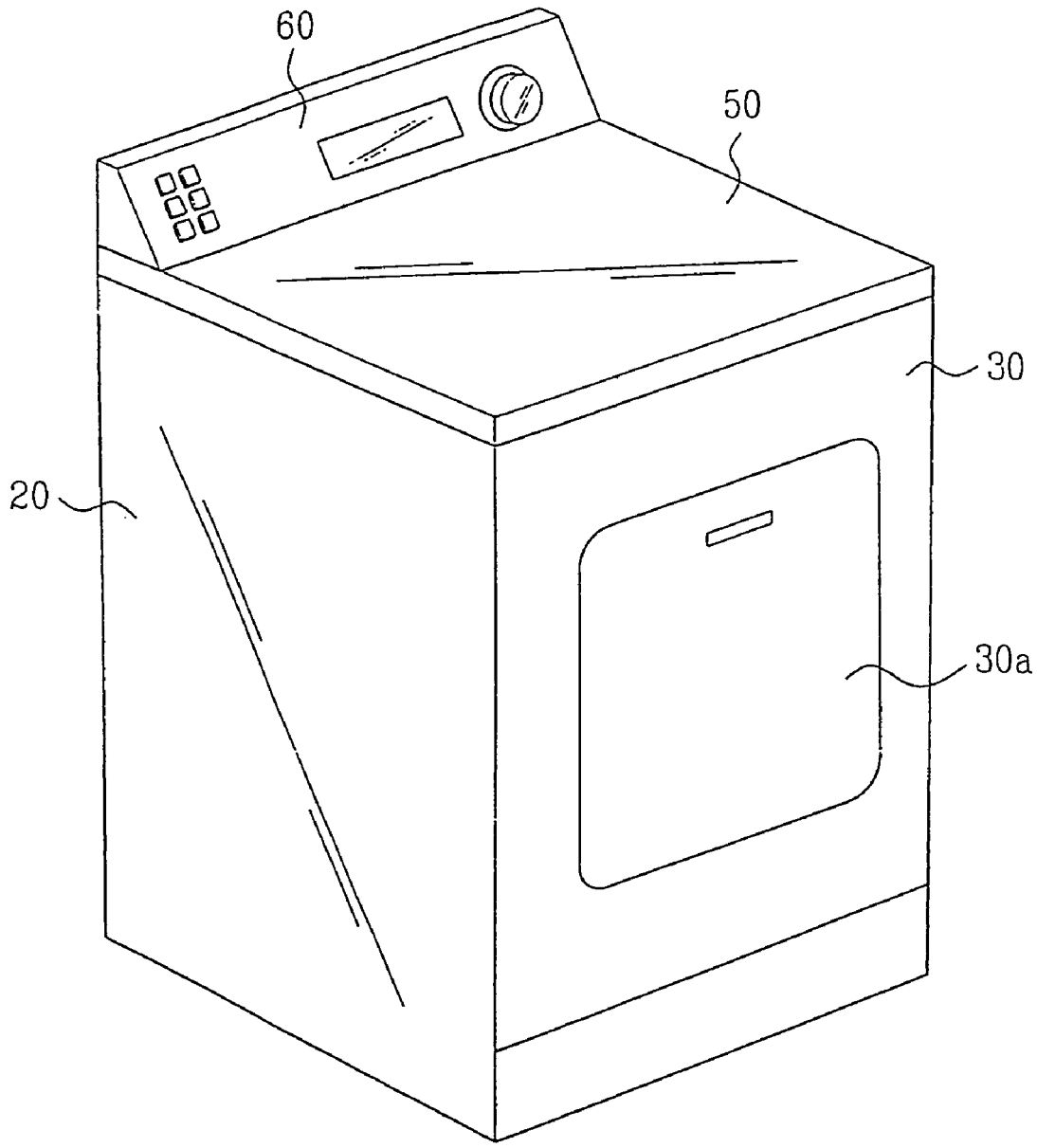
FIG. 1 illustrates a perspective view of a cabinet for a home appliance in accordance with a preferred embodiment of the present invention.
Figure 2:
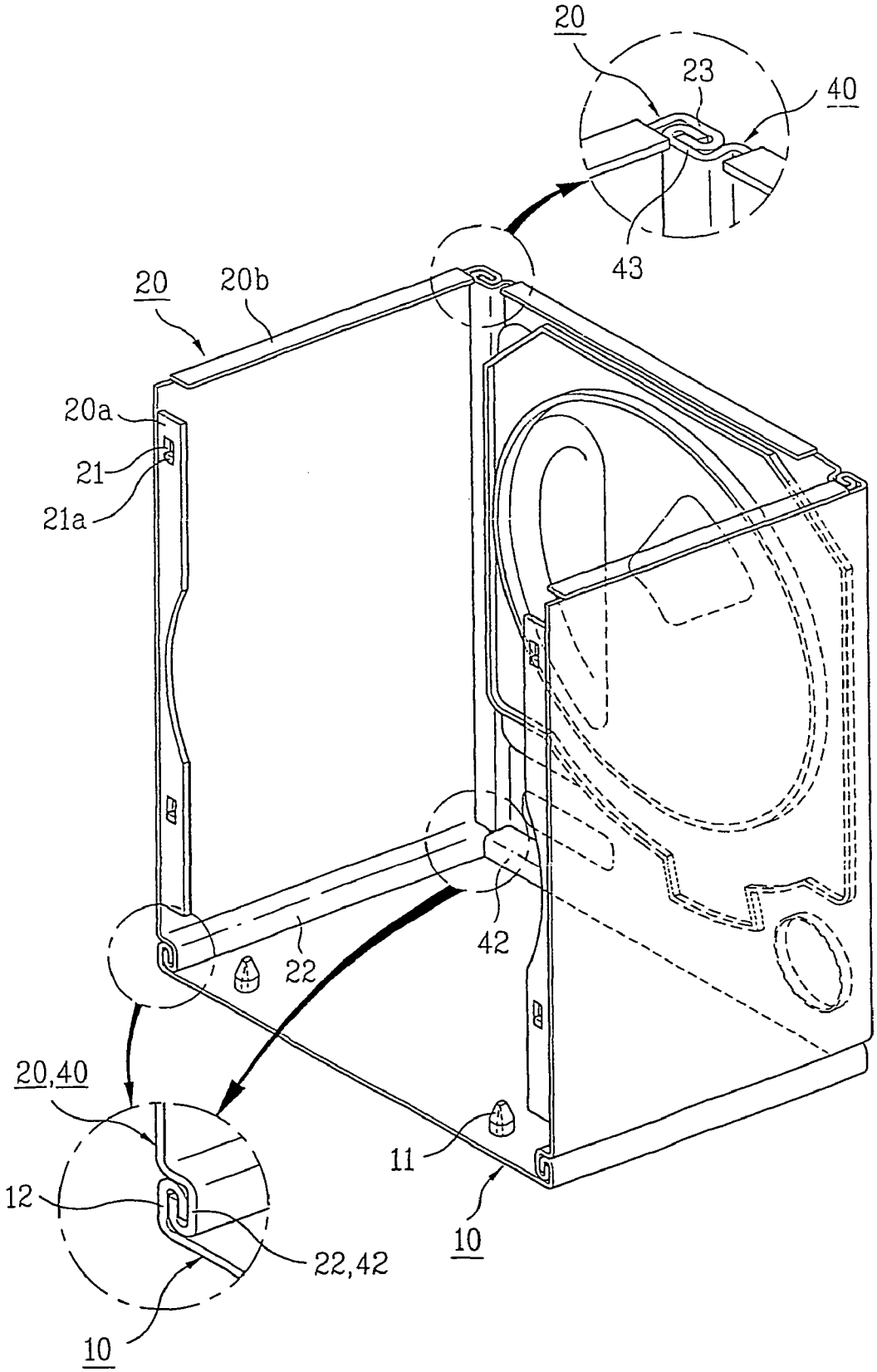
FIG. 2 illustrates a perspective view showing a base, side, and a rear panels of a cabinet for a home appliance of the present invention.

FIG. 1 illustrates a perspective view of a cabinet for a home appliance in accordance with a preferred embodiment of the present invention, and FIG. 2 illustrates a perspective view showing a base, side, and a rear panels of a cabinet for a home appliance of the present invention. As well known, in general cabinets of home appliances differ in size or shape depending on kinds of home appliances. Therefore, for convenience of description, though description of the present invention will proceed taking a washing machine or dryer as an example, the present invention is applicable to other home appliances.

The cabinet for a home appliance of the present invention includes base, side, front, rear, and top panels 10, 20, 30, 40, and 50, which are joined to one another, on the whole. As shown in FIG. 2 well, one pair of the side panels 20 are provided to opposite ends of the base panel 10, respectively. The front panel 30 and the rear panel 40 are provided to front and rear ends of the base panel 10 and the side panels 20, respectively. The top panel 50 is provided to top ends of the side, front, and rear panels 20, 30, and 40. The cabinet may have a control panel 60 mounted thereon for controlling the home appliance. Though such a control panel 60 is mounted on top of a top panel in FIG. 1, the position of mounting of the control panel 60 may be changed. Thus, the cabinet forms a space for holding and protecting major components of the home appliance.

In a case of the washing machine, there are a washing tub and driving means for rotating the washing tub mounted inside of the cabinet. In general, the driving means includes a motor, a driving shaft connected between the motor and the washing tub for driving the washing tub, and a clutch. Laundry is introduced into the washing tub through the door 30*a*, and the laundry is washed and extracted of water as the washing tub rotates. In the meantime, the door 30*a* may be mounted on the front panel 30 or the top panel 50 depending on arrangement of inside components, particularly, the washing tub. In a case of the dryer, the cabinet holds a drying drum, driving means for rotating the drying drum, and devices for heating and supplying air to the drum. Similar to the washing machine, the driving means may be a motor, a driving shaft, and a clutch. The heating device includes a heater, and a duct assembly for supplying air heated at the heater to an inside of the drying drum. The laundry washing in the washing machine is introduced into the drying drum through a door 30*b*, and dried by using the heater. For better drying of the laundry, the drying drum is rotated with driving means.

As described before, essentially, since the cabinet has a comparatively simple structure, a number of design factors influencing to characteristics of the cabinet are comparatively few. Of the design factors, a cabinet assembly system, i.e., joining parts of the panels, are important in view of a cabinet characteristic, particularly, improvement of productivity. The joining parts of the panels 10, 20, 30, 40, and 50 that fix an assembly system of the cabinet of the present invention will be described in more detail.

Referring to FIG. 2, with regard to the joining parts of the front and side panels 20, and 30, the side panel 20 has holes 21 in a front end for joining the front panel 30 to the side panel 20. In more detail, the side panel 20 has a flange 20*a* for holding the front panel 30, and the holes 21 are formed in the flange 20*a*. It is preferable that the holes 21 are formed in the front end of the side panel 20, more precisely, in upper and lower parts of the flange 20*a*, for stable holding of the front panel 30.

Figure 3:
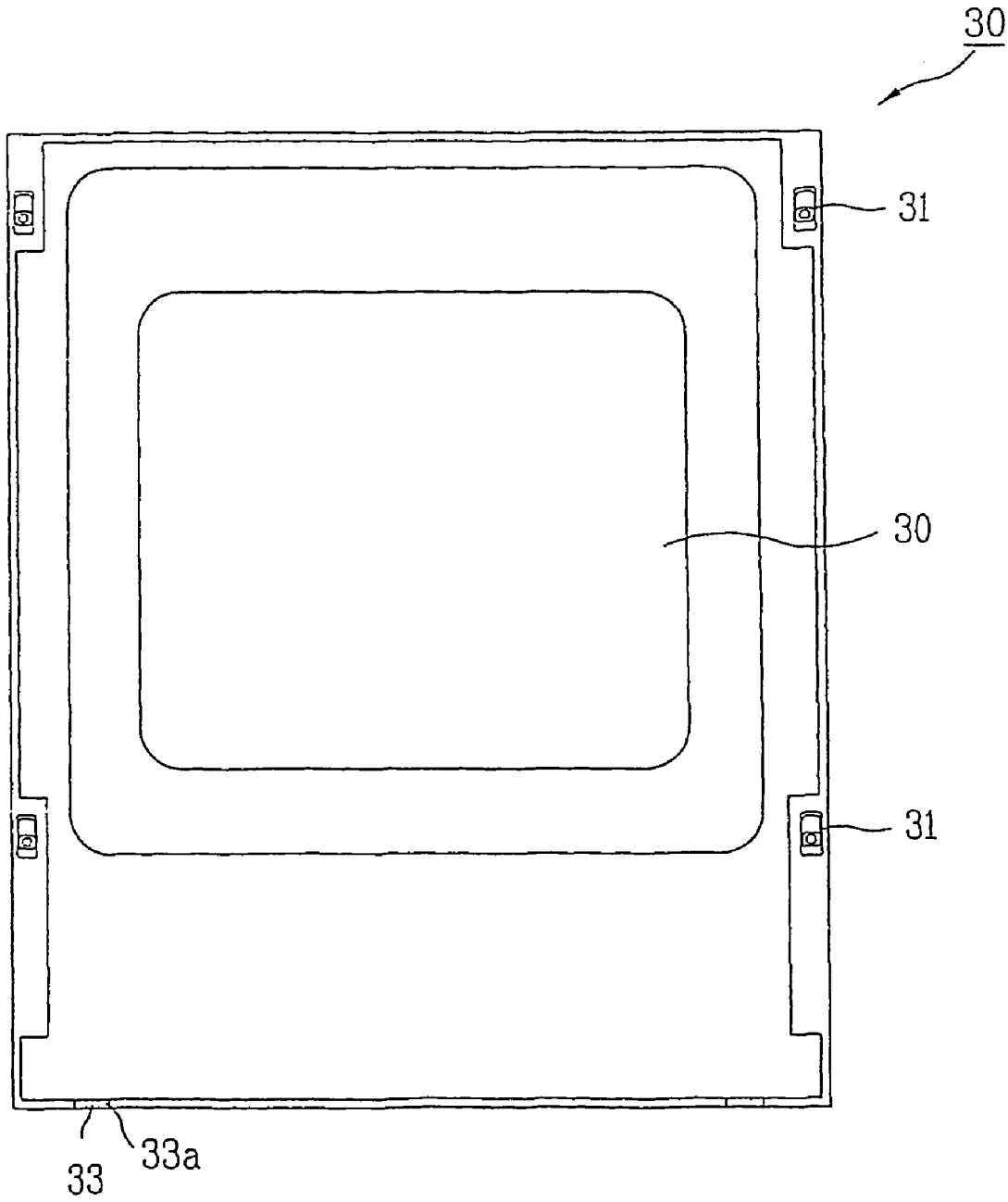
FIG. 3 illustrates a back view of a front panel of a cabinet for a home appliance in accordance with a preferred embodiment of the present invention.
Figure 4:
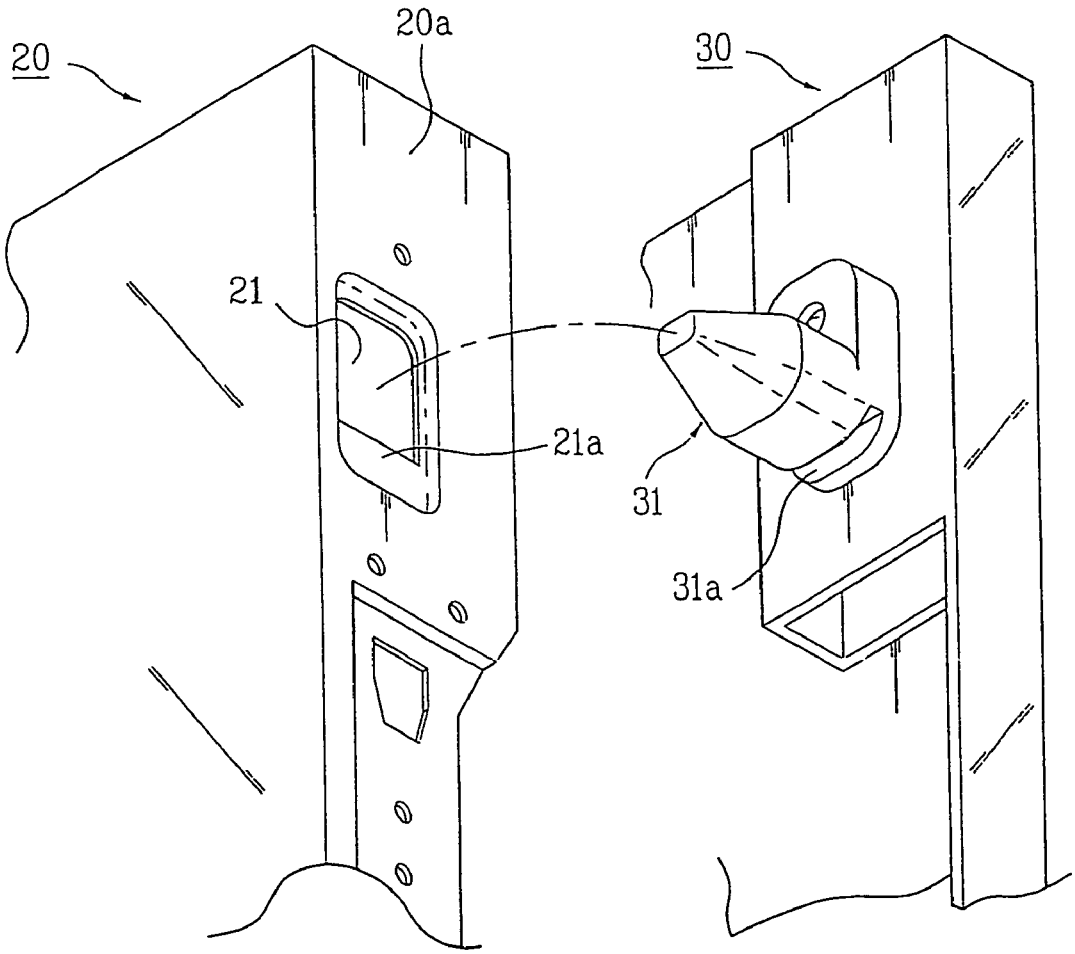
FIG. 4 illustrates a partial disassembled perspective view showing a first joining part between a front panel and a side panel of a cabinet for a home appliance in accordance with a preferred embodiment of the present invention.
Figure 6:
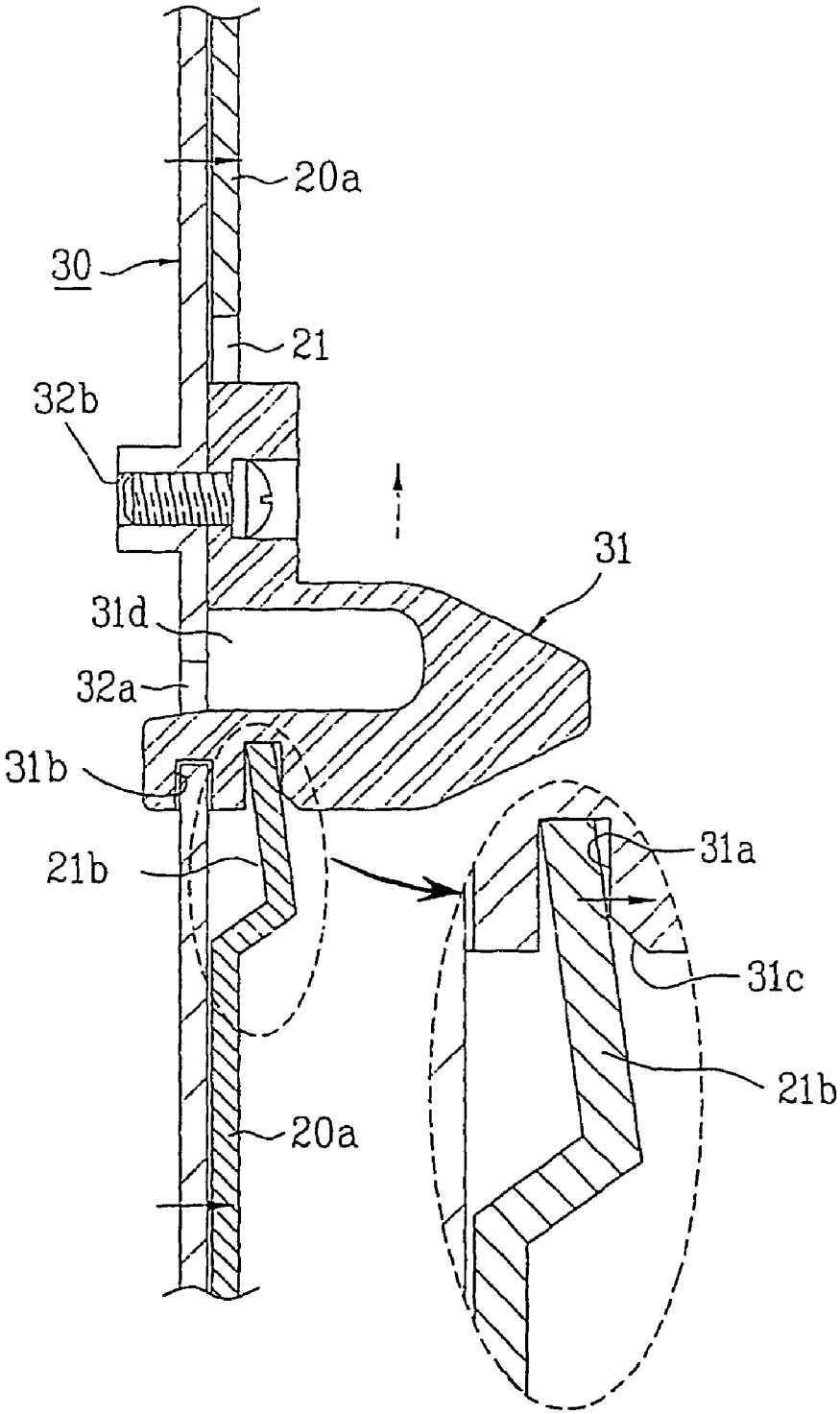
FIG. 6 illustrates a section showing assembled joining parts in FIG. 4.

Referring to FIGS. 3 and 4, for joining the side panels 20 with the holes 21, the front panel 30 includes projections 31 on a rear surface thereof. In the case the holes 21 are in the upper and lower parts of the front end of the side panel 20, the projections 31, in conformity to the holes 21, are also formed in upper and lower parts of rear end of the front panel 30. In more detail, referring to FIG. 4, the projections 31 are engaged with circumferential portions 21*a* of holes as the projections 31 are inserted in the holes 21, respectively. More precisely, the inserted projections 31 are caught at the circumferential portions 21*a* such that the inserted projections 31 are not broken away from the holes 21. To do this, the projection 31 has a groove 31*a* designed to be caught at the circumferential portion 21*a*, and, as shown in FIG. 6, the circumferential portion 21*a* is inserted in the groove 31*a* when the side panel 20 and the front panel 30 are joined. When the front panel 30 is joined with the side panel 20, weight of the front panel 30 is put downward through the projections 31, i.e., on the circumferential portions 21*a* of the holes 21. Therefore, if a lower part of the projection 31 is designed to engage with the circumferential portion 21*a* in a lower part of the hole 21, the engagement between the projection 31 and the circumferential portion 21*a* can be sustained by the weight of the side panel 30. Therefore, it is preferable that the groove 31*a* is formed in a lower surface of the projections 31. Under the same reason, as far as a force greater than weight of the front panel 30 is not given upward, upward movement of the front panel 30 joined to the side panel 20 is limited. At the same time with this, basically, movement of the projections 31 and the front panel 30 connected thereto in other directions are limited by the engagement between the projections 31 and the circumferential portions 21*a*. At the end, by means of the projections 31 and the holes 21, the side panels 20 and the front panel 30 are joined to each other firmly, which is very favorable as the firm joining can be made without mechanical fastening members. Moreover, as no fastening members are used, by moving the projection 31 upward as shown in an arrow in FIG. 6, the projection 31 can be separated from the hole 21 easily. That is, by lifting the front panel 30, the front panel 30 can be separated from the side panel 20, easily.

Moreover, if the groove 31*a* is formed adjacent to a rear surface of the front panel 30, a cross section area of a connection part between the projection 31 and the front panel 30 is reduced, with a subsequent reduction of strength of the connection part. Particularly, the connection part between the projection 31 and the front panel 30 sustains a shearing force from the circumferential portion 21*a* caused by the weight of the front panel 30. The reduction of the section area of the connection part results in earlier breakage of the projection 31, and reduction of lifetime of the cabinet itself. Therefore, as shown in FIG. 4, it is preferable that the groove 31*a* is spaced a distance away from the rear surface of the front panel 30. As shown in FIGS. 5 and 6, for engagement with such a groove 31*a*, the circumferential portion has a step part 21*b*. The step part 21*b* is positioned under the hole 21 so that the step part 21*b* can be inserted in the groove 31*a* in the lower part of the projection 31. Actually, the step part 21*b* is a bend of the circumferential portion 21*a* indent from the side panel 20. According to this, when the front panel 30 and the side panel 20 are joined, the step part 21*b*, a distance spaced from the rear surface of the front panel 30, can be inserted in the groove 31*a*, distanced in the same manner. In addition to this, since the groove 31*a* is a point the circumferential portion 21*a* supports the projection 31, the projection 31 can be supported more stably by the spaced groove 31*a* and the step part 21*b*.

By the projections 31 and the holes 21, the front panel 30 is joined with the side panels 20. However, for firmer joining, it is preferable that the projections 31 are pulled toward the side panels 20 by the circumferential portions 21*a* (or the step parts 21*b*). To do this, in the present invention, the projections 31 are engaged with the circumferential portions 21*a* (or the step parts 21*b*) while the projections 31 deform the circumferential portions 21*a* (or the step parts 21*b*). As an example, when the hole 21 has the step part 21*b*, as shown in FIGS. 5A and 5B showing the step part 21*b* and the projection 31, the groove 31*a* and the circumferential portion of the groove 31*a*, i.e., the step part 21*b*, are not in alignment, for deformation of the step part 21*b*.

Figure 5A:
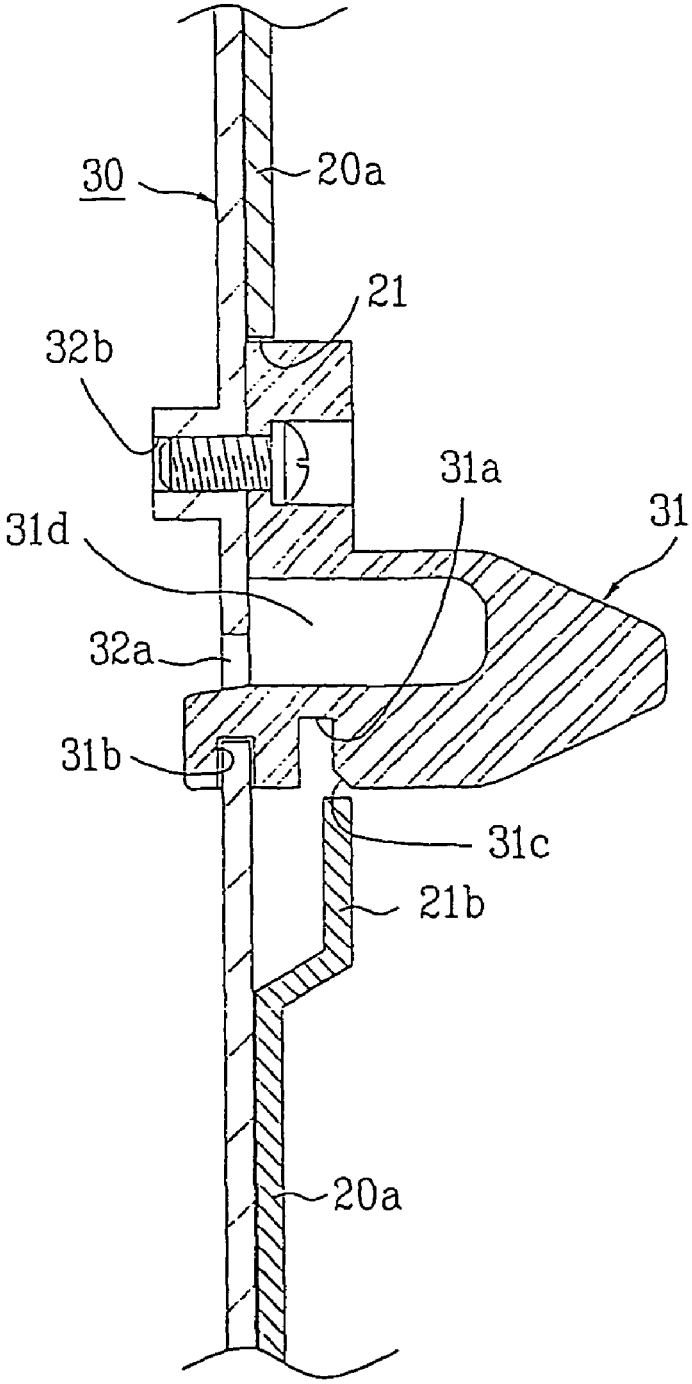
FIGS. 5A and 5B illustrate sections each showing the joining part in FIG. 4 before assembly.
Figure 5B:
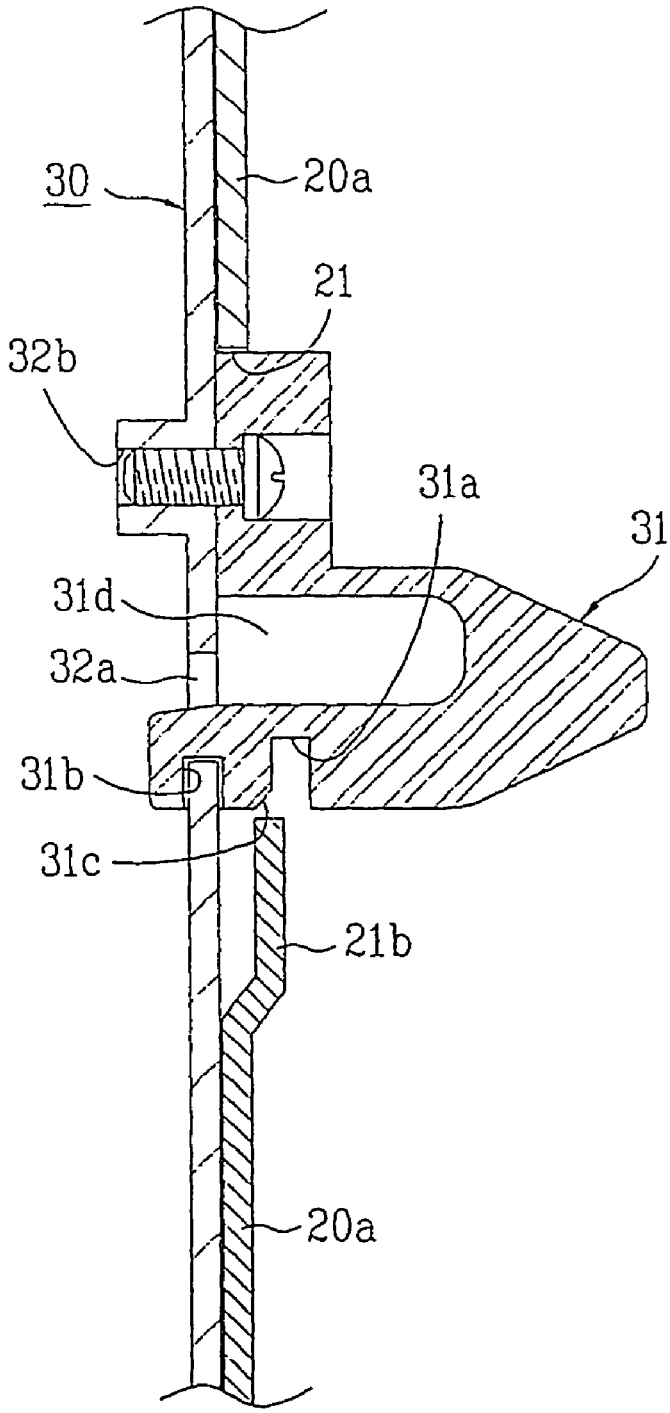

Referring to FIG. 5A, when the rear surface of the front panel 30 is brought into contact with the front end of the side panel 20, i.e., the flange 20*a* for engagement, the groove 31*a* may be positioned in forward of the step part 21*b*. In this instance, as shown in FIG. 6, the step part 21*b* is bent toward the front panel 30 during the engagement, and forcibly inserted into the misaligned groove 31*a*. The step part 21*b* applies a reaction force to the projection 31 as shown in a solid line arrow by an elasticity of the bent step part 21*b* itself, and the projection 31 is pulled by the step part 21*b*. Accordingly, the front panel 30 connected to the projections 31 comes closer to the side panels 20 and the base panel 10, and joined firmly. As shown in FIG. 5B, the groove 31*a* may be positioned in rear of the step part 21*b*. In such a case too, the joining between the side panels 20 and the front panel 30 can be strengthened by forced insertion of the step part 21*b* into the groove 31*a*. Preferably, the groove 31*a* may have an enlarged entrance for help insertion of the circumferential portion 31*a* therein. That is, the entrance of the groove 31*a* may be chamfered to form a chamfered surface 31*c*. The chamfered surface 31*c* is formed in a part the step part 21*b* is brought into contact at first, according to which an end of the step part 21*b* is guided so as to be inserted in the groove 31*a* easily. Alternatively, instead of the chamfered surface 31*c*, a rounded surface may be formed at the entrance. Such relative position, and chamfered surface 31*c* of the groove 31*a* can also be applied to the circumferential part 21*a* with no step part 21*b* without change for the same advantages.

As shown, the projection 31 has a section partially decreasing section. Therefore, the projection 31 can be inserted in the hole 21 easily. Preferably, the projection 31 is tapered so as to have a gradually decreased section. According to this, as shown, the projection 31 becomes to have a continuous sloped surface, such that the sloped surface is brought into contact with the circumferential surface of the hole, and guides the projection 31 to be inserted in the hole 21 easily. Moreover, the projection 31 may be a separate member mounted on the front panel 30, or may be formed as one unit with the front panel 30. In a case the projection 31 is a separate member, the projection 31 may further include a guide groove 31*b* form to be joined with the front panel 30. In more detail, the guide groove 31*b* is engaged with the circumferential portion of the guide hole 32*a* in the front panel 30. The front panel 30 may have a fastening hole 32*b* for fastening the projection 31 with a fastening member and the fastening hole 32*b*. It is preferable that neighborhood of the guide groove 31*b* is deformable. For this, the projection has a cavity 31*d* therein. According to this, at first by deforming the neighborhood of the guide groove 31*b*, the guide groove 31*b* can be engaged with the circumferential portion of the guide hole 32*a*, and by this engagement, the projection 31 can be positioned on the rear surface of the front panel 30, securely. Thereafter, the projection 31 is fastened to the fastening hole 32*b* in the front panel 30 with the fastening member. Opposite to this, at first the projection 31 may be fastened to the fastening hole 32*b*. Then, as the circumferential portion of the guide groove 31*b* is deformed owing to the cavity 31*d*, and the guide groove 31*b* is engaged with the circumferential portion of the guide hole 32*a*.

Figure 8:
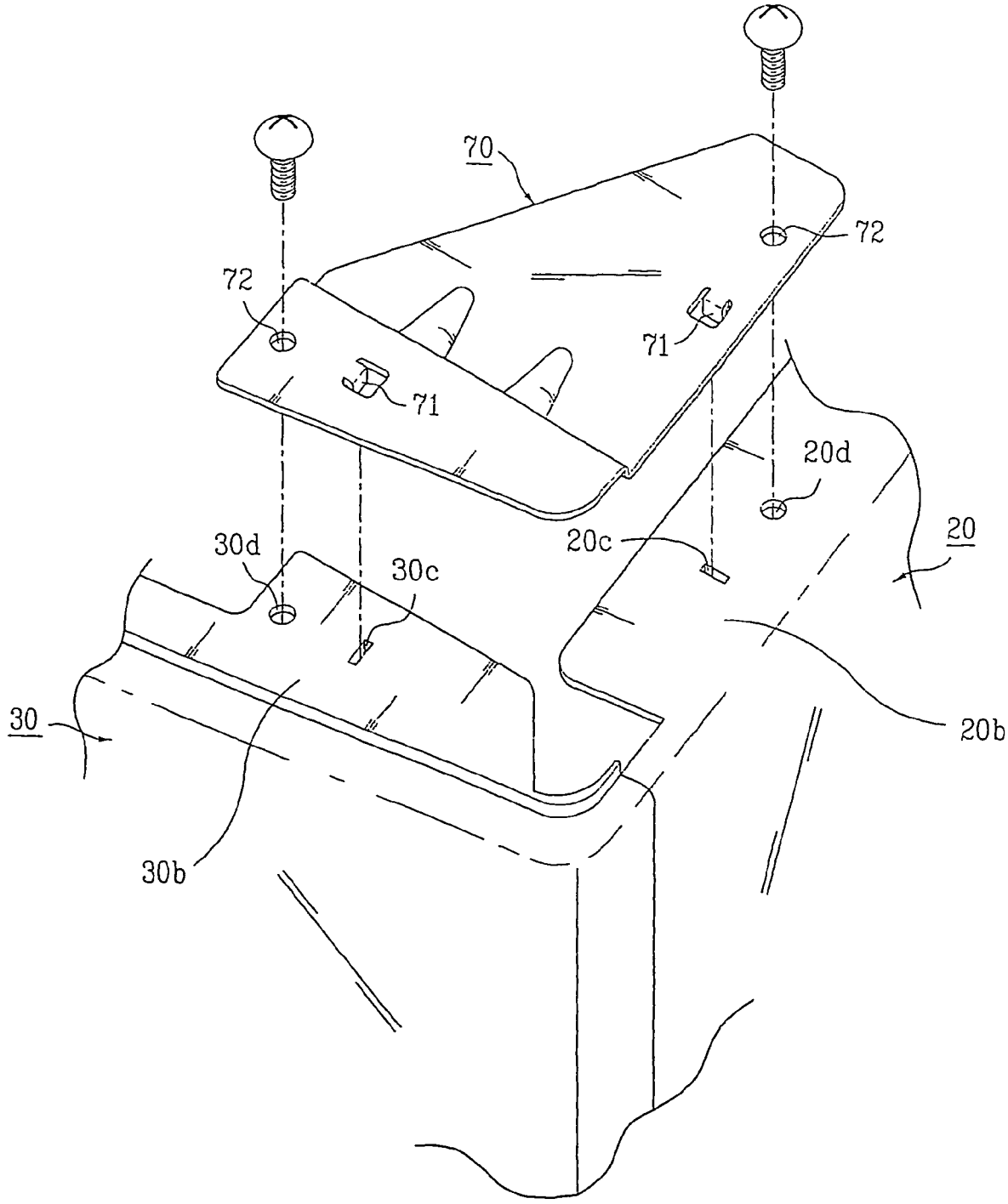
FIG. 8 illustrates a partial disassembled perspective view showing second joining parts between front and side panels of a cabinet for a home appliance.

Referring to FIG. 8, for more positive joining between the front panel 30 and the side panels 20, the cabinet of the present invention further includes a bracket 70 at a corner formed at top ends of the front and side panels 20 and 30. The top ends of the front and side panels 30 and 20 have flanges 30*b* and 20*b* respectively, and the bracket 70 joins the flanges 30*b* and 20*b*, together. In more detail, the flanges 20*b* and 30*b* have guide holes 20*c* and 30*c* respectively, and the bracket 70 has projections 71 to be inserted in the guide holes 20*c* and 30*c*. The projections 71 may be formed by lancing. That is, when the bracket 70 is pierced with a tool, the pierced part of the bracket 70 is bent to form the projection 71 as shown. Also, the flanges 20*b* and 30*b* have fastening holes 20*d* and 30*d* respectively, and the bracket 70 has fastening holes 72 in correspondence to the fastening holes 20*d* and 30*d*. According to this, the bracket 70 is stably positioned on the flanges 20*a* and 30*b* with the projections 71 and the guide holes 20*c* and 30*c*. Thereafter, the bracket 70 is fastened to the flanges 20*a* and 30*b* with the fastening holes 72, 20*d* and 30*d* and the fastening members.

Figure 7A:
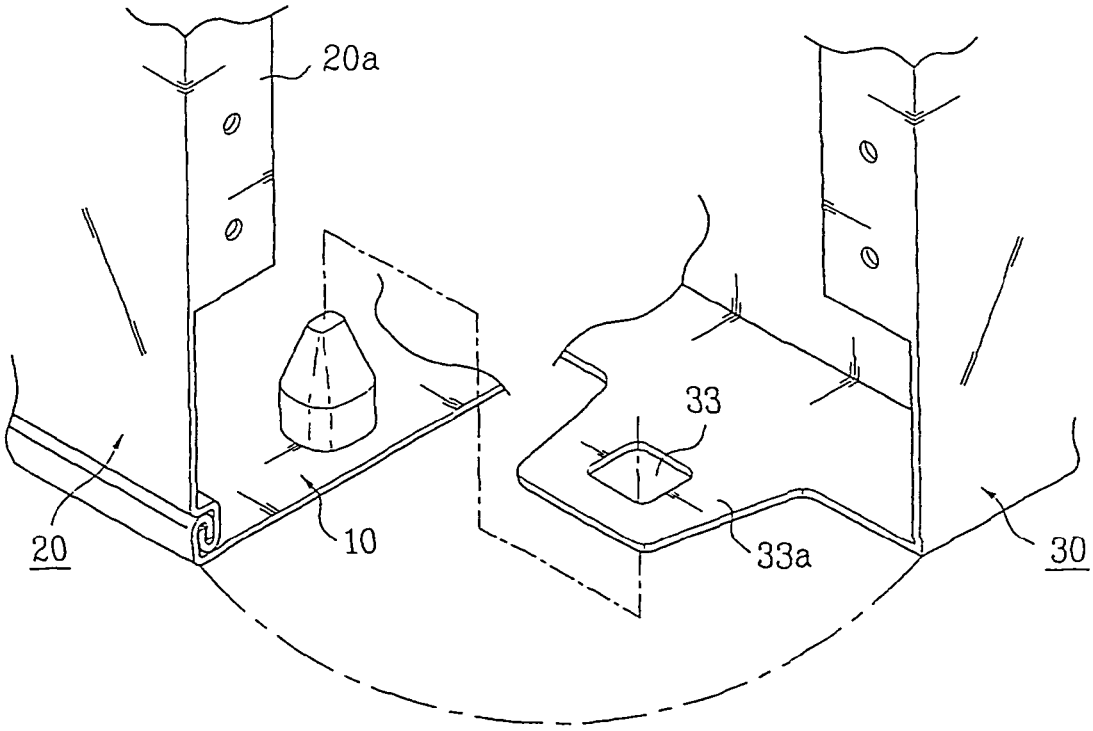
FIG. 7A illustrates a partial disassembled perspective view showing joining parts between a front panel and a base panel of a cabinet for a home appliance in accordance with a preferred embodiment of the present invention.
Figure 7B:
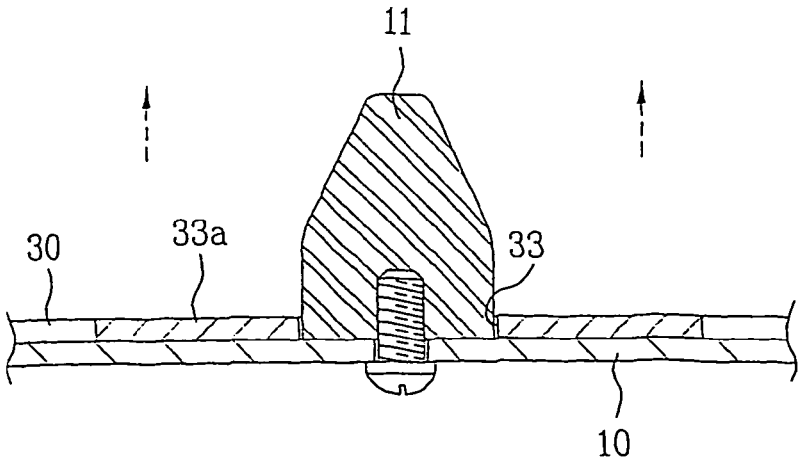
FIG. 7B illustrate a section of the assembled joining part in FIG. 7A.

FIGS. 7A and 7B illustrate joining parts of the front panel 30 and the base panel 10 in detail. Referring to the drawings, the front panel 30 has a supplementary hole 33 in a lower end part additionally. The supplementary hole 33 is formed in the flange 33*a* at a lower end of the front panel 30, preferably opposite side parts of the lower end. The base panel 10 has a supplementary projection 11 to be engaged with the supplementary hole 33 in a front end part. The supplementary projections 11 are mounted in opposite side parts of the front end part. The supplementary projections 11 are inserted in the supplementary holes 33 such that the front panel 30 is joined with the base panel 10 at the same time with joining of the front panel 30 with the side panels 20. In more detail, since the supplementary projection 11 is vertically extended from the base plate 10, once the supplementary hole 33 is engaged with the supplementary projection 11, movements of the supplementary hole 33 and the flange 33*a*, furthermore, the front panel 30, are limited in all directions except an upper direction. As described before, weight of the front panel 30 is applied downward to the vicinity of the supplementary projection 11 through the flange 33*a*. By the weight of the front panel 30, the engagement between the supplementary projection 11 and the supplementary hole 33 can be sustained. Under the same reason, as far as a force greater than the weight of the front panel 30 is not given upward, upward movement of the front panel 30 is limited. Accordingly, by means of the supplementary hole 33 and the supplementary projection 11, the front panel 30 is joined to the base panel 10, firmly. Alternatively, as no fastening members are used, the supplementary projection 11 can be separated from the supplementary hole 33 and the flange 33*a* easily by moving the supplementary hole 33 and the flange 33*a* upward as indicated in a dashed arrow in FIG. 7B. That is, by lifting the front panel 30, the front panel 30 can be separated from the base panel 10 with easy.

It is preferable that the supplementary projection 11 has a sectional area the same with a size of the supplementary hole 33 for forced insertion of the supplementary projection 11 into the supplementary hole 33. According to this, movement of the supplementary projection 11 within the hole 33 is positively limited such that the front panel 30 is joined with the base panel 10, more firmly. Similar to the projection 31, the supplementary projection 11 also has a partially reduced section so as to be inserted in the supplementary hole 33 easily. Actually, the supplementary projection 11 is tapered to have a gradually reduced section. The supplementary projection 11 is a separate member mounted on the base panel 10, or may be formed as one unit with the base panel 10. FIGS. 7A and 7B illustrate the supplementary projection formed as a separate member.

Joining parts between the base panel 10, the side panels 20, and the rear panel 40 will be described with reference to FIG. 2. In the present invention, the base, side, and rear panels 10, 20, and 40 are engaged to one another. That is, as shown, edges of the joining part of the base, side, and rear panels 10, 20, and 40 are curled. The curled opposite edges are inserted to each other, and firmly attached. In more detail, the joining parts of the base and side panels 10 and 20 include first curled portions 12 at opposite edges of the base panel 10, and second curled portions 22 at lower edges of the side panels 20 engaged, and joined with the first curled portions 12. Alikely, the joining parts between the base and rear panels 10 and 40 include a first curled portion 12 at a rear edge of the base panel 10, and a second curled portion 42 at a lower edge of the rear panel 40 engaged with the first curled portion. On the other hand, the joining parts between the side and rear panels 20 and 40 include third curled portions 23 at rear edges of the side panels 20, and fourth curled portions 43 at side edges of the rear panel 40 engaged with the third curled portions 23. By means of the first to fourth curled portions 12, 22, 42, 23, and 43, the panels 10, 20, and 40 can be joined securely even without fastening members. The curled portions may be formed partially at respective edges, preferably the curled portions are formed throughout respective edges. According to this, respective edges are engaged with each other throughout the edges, to strengthen the joining between the panels 10, 20, and 40.

Thus, in the cabinet of the present invention, the panels 10, 20, 30, and 40 are joined firmly by means of respective joining parts. An assembly process of the cabinet of the present invention will be described with reference to the attached drawings, in detail.

In general, for consistent and convenient assembly of a home appliance, the base, side, and rear panels 10, 30, and 40 are assembled as shown in FIG. 2 for forming a base frame for holding various components therein. As described before, in the present invention, curled portions are formed at edges of the base, side, and rear panels 10, 30, and 40, and engaged, and joined with one another. Since the curling is done once through by a machine tool, a process time is reduced significantly. Moreover, the panels 10, 20, and 40 have smooth and continuous joined parts, and since the joined parts are at edges of the panels, joining strength is increased, substantially.

Various components are mounted in an inside space of the panels 10, 20, and 40 assembled thus. For an example, in a case of a washing machine, a washing drum and driving means for rotating the drum are mounted in the inside space. In a case of a dryer, a drying drum, driving means for rotating the drying drum, hot air producing means, and etc., are mounted therein.

Then, the front panel 30 is joined to the side and base panels 20 and 10 joined to each other as shown in FIG. 2. Referring to FIGS. 5 and 6, in this joining process, when the front panel 10 is pushed against fore ends of the base and side panels 10 and 30, the projections 31 on the front plate 30 are inserted in the holes 21 in the side plate 20. As described before, the projection 31 has the reduced section (i.e., the tapered surface), and, in addition to this, the hole 21 is also a little greater than the projection 31. Therefore, the projection 31 is inserted in the hole 21 easily. Along with this, the supplementary guide 11 in the base panel 10, and the supplementary hole 33 in the front panel 30 are also aligned to each other so as to be engaged with each other.

After the insertion of the projection 31 and the alignment of the supplementary projection 11, when the front panel 10 is moved down, the circumferential portion 21*a* of the hole 21 is inserted in the groove 31*a* of the projection 31. If the groove 31*a* is spaced from the rear surface of the front panel 30, the step part 21*b* which is a portion of the circumferential portion 21*a* is inserted in the groove 31*a*, and supports the projection more securely. When the groove 31*a* and the circumferential portion 21*a* (or the step part 21*b*) are not aligned, preferably, when the groove 31*a* is positioned in front of the circumferential portion 21*a* (or the step part 21*b*), the circumferential portion 21*a* (or the step part 21*b*) is inserted, and deformed, to pull the projection 31 with its elasticity. According to this, the front panel 30 connected to the projection 31 is brought into close contact with the side panels 20 and the base panel 10, according to which a gap between the panels are minimized. Moreover, as the front panel 10 is moved down, the supplementary projection 11 on the base plate 10 is inserted in the supplementary hole 33 as shown in FIG. 7B.

By such an engagement of the projection 31 with the hole 21, and of the supplementary projection 11 with the supplementary hole 33, the front panel 30 is respectively joined with the side panels 20 and the base panel 30, firmly. Moreover, as the joining is made with easy without fastening members, a working time period and a working process are reduced. On the other hand, by moving the front panel 30 upward, the front panel 30 is separated from the side panels 20 and the base panel 10 in a process opposite to the joining process described before. As the separating process is also simple, a short time period is required.

Finally, the top panel 50 is joined with the side, front, and rear panels 20, 30, and 40 joined together. The top panel 50 may be fastened to top ends of the panels with general fastening members, such as screws. However, preferably, by using the foregoing projections or curling in the joining, the working time period can be reduced in the same manner.

In the meantime, though one specific embodiment is disclosed in above, the present invention is not limited to the embodiment.

For an example, the hole 21 may be formed in the front panel 30 instead of the side panels 20, and the projection 31 engaged with the hole 21 is mounted on the side panels 20 instead of the front panel 30. Alikely, the supplementary projection 11 may be mounted on the front panel 30, and the supplementary hole 33 may be formed in the base panel 10. The hole and the supplementary hole 21 and 33 may be circular or other form, other than the rectangular form shown in the drawings, and the projection and the supplementary projection 31 and 11 may be changed in conformity with the hole and the supplementary hole 21 and 33. Moreover, though the foregoing embodiment discloses a cabinet applied to a washing machine or a dryer, the cabinet of the present invention is also applicable to other home appliance without large variation as required. It is apparent from the foregoing detailed description of the preferred embodiment that each of variations of the embodiment has the same features and effects with the foregoing embodiment, actually.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

In the cabinet of the present invention, the projections and the supplementary projections of the front and side panels are designed to be inserted and engaged with respective holes and supplementary holes in the side panels and base panel, directly. By means of the holes/ the supplementary holes and the projection/the supplementary projections, the front panel can be joined with the side panels and the base panel without fastening members. Moreover, the base panel, the side panels and the rear panel are joined by one time of curling process, to one another. Therefore, the cabinet of the present invention can be assembled easier than the related art cabinet that uses fastening members actually, according to which a time period required for the assembly is reduced significantly. At the end, productivity is increased and production cost is reduced. Also, under the same reason, the cabinet of the present invention, particularly, the front panel, can be disassembled with easy actually, according to which repair and maintenance of the home appliance can be made conveniently.

Moreover, the hole and the projection are designed such that the front panel is brought into close contact with the side panels, and joining parts of the base, side, and rear panels are formed continuous along edges of the panels by curling. Therefore, fastening force between the panels is increased substantially, and leakage of noise through a gap between the panels can be prevented.

What is claimed is:

1. A cabinet for a home appliance comprising:

a base panel;

one pair of side panels respectively provided to side ends of the base panel, each having a plurality of holes in a front surface of a front end;

a front panel provided to front ends of the base panel and the side panels, the front panel having projections mounted on a rear surface thereof for being inserted in the plurality of holes and engaged with a circumferential portion of each of the plurality of holes, respectively such that the projections are pulled toward the side panels by the circumferential portion and engage with the circumferential portion while the projections deform the circumferential portion, partially;

wherein the projections have a groove for receiving the circumferential portion of the hole for engagement with the circumferential portion;

wherein the circumferential portion of each of the plurality of holes is indented to lie in a plane that is offset from the surface of the front end; and a rear panel provided to rear ends of the base panel and the side panels.

2. The cabinet as claimed in claim 1, wherein at least one of the plurality of holes is formed in a flange at a front end of the side panel.

3. The cabinet as claimed in claim 1, wherein the plurality of holes are formed in an upper part and a lower part of the front end of each of the side panels.

4. The cabinet as claimed in claim 1, wherein the projections are formed in an upper part and a lower part of edges of the rear surface of the front panel.

5. The cabinet as claimed in claim 1, wherein the projections have a lower part engaged with the circumferential portion in a lower part of the plurality of holes.

6. The cabinet as claimed in claim 1, wherein the groove is in a lower surface of the projection.

7. The cabinet as claimed in claim 1, wherein the groove is spaced a distance away from the rear surface of the front panel.

8. The cabinet as claimed in claim 1, wherein the circumferential portion engaged with the projection includes a step part.

9. The cabinet as claimed in claim 8, wherein the step part is positioned in a lower part of the plurality of holes.

10. The cabinet as claimed in claim 1, wherein the groove in the projections and the circumferential portion are not in alignment when the side panel and the front panel are joined.

11. The cabinet as claimed in claim 10, wherein the groove is in front of the circumferential portion.

12. The cabinet as claimed in claim 1, wherein the groove has an enlarged entrance for helping insertion of the circumferential portion of the hole therein.

13. The cabinet as claimed in claim 12, wherein the entrance of the groove includes a chamfered surface.

14. The cabinet as claimed in claim 12, wherein the entrance of the groove includes a rounded surface.

15. The cabinet as claimed in claim 1, wherein the projection has a partially reduced section for easy insertion into the hole.

16. The cabinet as claimed in claim 15, wherein the projection is tapered.

17. The cabinet as claimed in claim 1, wherein the projection is a separate member attached to the front panel, or formed as one unit with the front panel.

18. The cabinet as claimed in claim 1, wherein the projection includes a guide groove to be engaged with a circumferential portion of a guide hole in the front panel.

19. The cabinet as claimed in claim 18, wherein the projection further includes a cavity for deforming a neighborhood of the guide groove.

20. The cabinet as claimed in claim 1, wherein the projection is separated from the hole by moving the projection upward.

21. The cabinet as claimed in claim 1, further comprising a bracket provided to a corner in which top ends of the front panel and the side panel form.

22. The cabinet as claimed in claim 21, wherein the bracket is fastened both to a top end flange of the front panel and a top end flange of the side panel.

23. The cabinet as claimed in claim 22, wherein the flanges of the front and side panels include guide holes respectively, and the bracket includes projections for inserting into the guide holes respectively.

24. The cabinet as claimed in claim 23, wherein the projections are formed by lancing.

25. The cabinet as claimed in claim 1, wherein the front panel further includes a supplementary hole in a lower end thereof, and the base panel further includes a supplementary projection on a front end thereof inserted in the supplementary hole.

26. The cabinet as claimed in claim 25, wherein the supplementary hole has a size identical to a section area of the supplementary projection.

27. The cabinet as claimed in claim 25, wherein the supplementary projection has a partially reduced section for easy insertion into the supplementary hole.

28. The cabinet as claimed in claim 27, wherein the supplementary projection is tapered.

29. The cabinet as claimed in claim 25, wherein the supplementary projection is separated from the hole by moving the hole upward.

30. The cabinet as claimed in claim 1, wherein the base panel is joined with the side panel and the rear panel without fastening members, directly.

31. The cabinet as claimed in claim 30, wherein the base panel further includes first curled parts at side edges and rear edge thereof, and the side panels and the rear panel further include second curled parts at lower edges thereof respectively for engagement and joining with the first curled parts respectively.

32. The cabinet as claimed in claim 1, wherein the side panels and the rear panel are joined to each other directly, without fastening members.

33. The cabinet as claimed in claim 32, wherein the side panels include third curled parts formed at rear ends respectively, and the rear panel includes fourth curled parts at side ends respectively for engagement, and joining with the third curled parts respectively.

* * * * *